United States Patent [19]

DeVitis

[11] 4,032,249

[45] June 28, 1977

[54] APPARATUS FOR GROOVING CONCRETE

[76] Inventor: Louis DeVitis, Millstone Road, Perrineville, N.J. 08835

[22] Filed: Nov. 12, 1976

[21] Appl. No.: 737,441

[52] U.S. Cl. ..... 404/89; 404/93

[51] Int. Cl.[2] ..... E01C 23/02

[58] Field of Search ..... 404/89, 93; 254/161, 254/162

[56] References Cited

UNITED STATES PATENTS

| | | | |
|---|---|---|---|
| 775,110 | 11/1904 | Jumper | 404/93 X |
| 1,726,665 | 9/1929 | Heltzel | 404/89 |
| 1,916,887 | 7/1933 | McClain | 404/93 |
| 1,950,673 | 3/1934 | Heltzel | 404/89 X |
| 2,555,457 | 6/1951 | Rose | 254/161 X |
| 2,949,068 | 8/1960 | Gresham | 404/89 |
| 3,348,812 | 10/1967 | Story | 254/161 |
| 3,936,210 | 2/1976 | Oehlerking | 404/89 |

*Primary Examiner*—Nile C. Byers
*Attorney, Agent, or Firm*—Roger A. Clapp

[57] ABSTRACT

A float and guide assembly are disclosed for grooving wet mortar. The float assembly comprises a float, grooving rib, handle and two track brackets for guidably engaging a cable. The cable is part of the guide assembly which includes drum and ratchet assemblies which cooperate to hold the cable a predetermined height above the mortar and which impart tension to the cable so it can act as a guide.

7 Claims, 3 Drawing Figures

APPARATUS FOR GROOVING CONCRETE

BACKGROUND OF THE INVENTION

1. Field of the Invention

The invention relates to tools for working wet mortar such as concrete and pertains in particular to apparatus for imparting a groove to the mortar; i.e., to form an expansion crack.

2. Description of the Prior Art

Mortar such as concrete poured in a long strip as for a sidewalk requires the establishment of perforated points where stress fracture can occur. Typically, the stress fracture points are grooves cut in the surface of the wet mortar. Traditionally, floats having a rib on one side are used to impart the necessary groove as, for example, shown in U.S. Pat. Nos. 775,110 issued to O. M. Jumper and 1,916,887 issued to W. T. McClain on July 4, 1933. While these arrangements are generally satisfactory, simpler and more efficient arrangements will achieve economies and convenience heretofore not available.

Accordingly, an object of this invention is to achieve simple and convenient grooving of wet mortar.

SUMMARY OF THE INVENTION

In accordance with the preferred embodiment of the invention, simplicity and convenience in grooving is achieved by combining a float assembly and a guide assembly wherein the float assembly has track brackets and a grooving rib and the guide assembly includes a cable which restricts the track guides and, in turn, the grooving grip, to a predetermined path over the mortar to be grooved.

In accordance with one feature of this invention, a drum assembly in the guide assembly locates the cable a predetermined height above the mortar to facilate accurate grooving.

In accordance with another feature of this invention, a ratchet assembly in the guide assembly tensions a cable between itself and the drum assembly so as to form a convenient guide reference for the float assembly.

In accordance with another feature of this invention, the float assembly includes opposed track brackets adapted to engage the cable so as to simplify accurate movement of the float assembly.

A better understanding of these and other features and objects of the invention will be facilitated by reference to the following drawing and detailed description.

DESCRIPTION OF THE INVENTION

Figure 1:
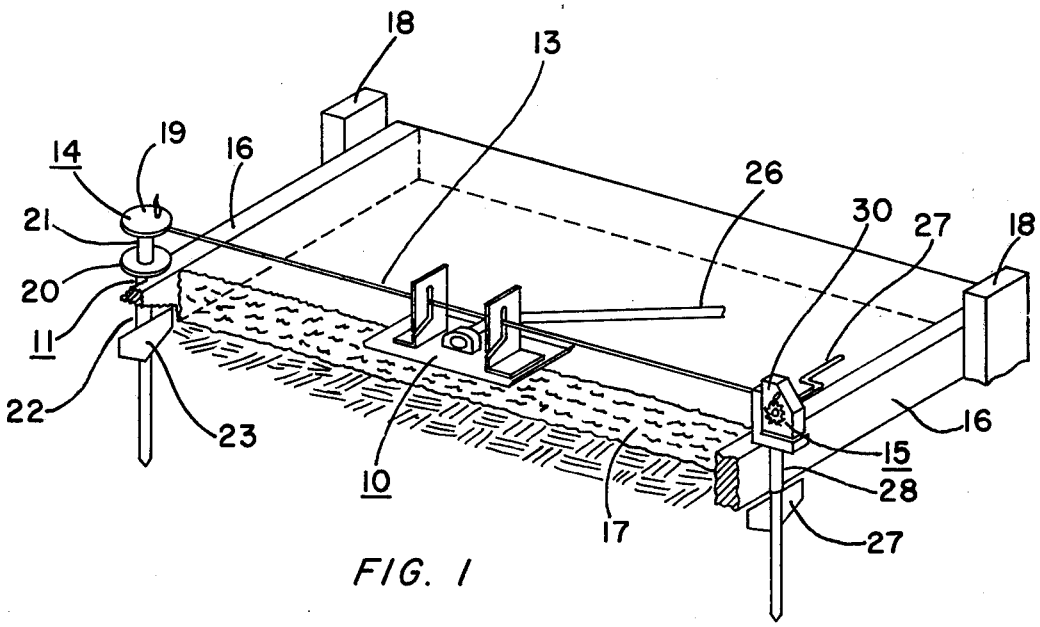
FIG. 1 is a perspective view illustrating a float assembly and guide assembly cooperating in accordance with this invention.
Figure 2:
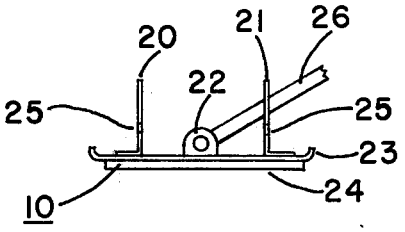
FIG. 2 is a side elevation view of the float assembly shown in FIG. 1.
Figure 3:
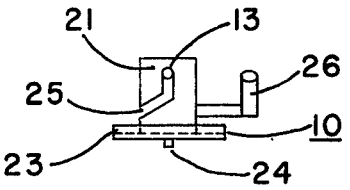
FIG. 3 is an end elevation view of the float assembly shown in FIG. 1.

Referring to FIG. 1, a float assembly 10 and a guide assembly 11 are shown. As shown in FIG. 2, the float assembly 10 comprises a pair of track brackets 20 and 21, a handle bracket 22, a float 23 and a rib 24. The float 23 is advantageously formed from a rigid material such as sheet steel and the rib 24 projects outwardly along the length thereof at a height of approximately three quarters of an inch. Typically, the float 23 is 3 to 6 inches wide and 6 to 10 inches long.

The handle bracket 22 is rigidly attached to the float 23 as by welding and is adapted to accept a handle 26.

The track brackets 20 and 21 are also rigidly attached to the float 23 as by welding and can be individual units or made from a single unitary piece. In either case, they are typically made of a rigid material such as sheet steel and each includes a slot 25 which has a width of approximately ⅛ inch terminating in an opening adapted to accomodate a cable 13.

The cable 13 is advantageously 3/32 inch steel and is a part of the guide assembly 11 which also includes a drum assembly 14 and a ratchet assembly 15. As shown in FIG. 1, the drum and ratchet assemblies 14 and 15 are adapted to rest on forms 16 which contain wet mortar 17 such as concrete or the like and which are partially held in place by the stakes 18.

As best seen in FIG. 1, the drum assembly 14 comprises two flanges 19 and 20 separated by a center section or drum 21. One flange 20 rests on the form 16 and the drum 21 spaces the other flange 19 a predetermined height above the form 16. All of the components of the drum assembly 14 are advantageously made of sheet steel and the flange 19 is perforated to accept one end of the cable 13 while the drum 21 and the flange 20 are hollow and perforated respectively to accept a stabilizer stake 28.

Each stabilizer stake 28 is advantageously a five eighth inch circular rod made of iron. Moreover, each includes a skirt 29 adapted to assist in spacing and tensioning the cable 13.

The ratchet assembly 15 is a typical drum take-up and includes a suitable ratchet control drum (not shown), a handle 27 and a housing 30. The housing 30 holds the other components in place and includes a hollow portion adapted to accomodate the top of a stabilizing stake 28. As shown in FIG. 1, the housing 25 rests on the form 16 when mounted in place and, as a result, the cable 13 is located a predetermined height above the mortar 17.

In operation, a pair of stabilizer stakes 28 are oppositly installed in the ground in place of the pair of normal stakes 18 adjacent to the place in the mortar 17 where a groove is to be cut. Next, the drum and ratchet assemblies 14 and 15 are mounted on top of their respective stabilizer stakes 28. The cable 13 is then stretched between the two assemblies to form a guide wire and the handle 25 turned until the desired cable tension is reached; i.e., when the forms 16 start to pull slightly inward.

Next, the float assembly 10 is placed on the mortar 17 and the cable 13 is inserted in the slots 25. Thereafter, the float 23 is pushed with a steady motion across the mortar 17 by the handle 26. If desired, the float 23 can be pulled back to further define the groove or it can be merely lifted off and transported to the next groove location.

If desired, the float 23 can be made with a double set of parallel track brackets 20 and 21. In that case, the float 23 is made doubly wide. In either case, the slots 25 are opened so as to readily accept the cable 13.

When the float and guide assemblies 10 and 11 are used, bridging planks are not needed to span the fresh mortar. Moreover, the grooves are readily made by one man. As a result, significant economies are achieved in making grooves in fresh concrete.

In summary, a float and guide assembly have been disclosed which simplify and make more efficient the process of grooving wet mortar. While only one embodiment has been disclosed, that embodiment is illustrative of the principals of the invention and many others falling within the scope of the invention will readily occur to those skilled in the art.

What I claim is:

1. In apparatus for grooving wet mortar or the like, the combination comprising:

A guide assembly comprising a cable extending between a drum assembly and a ratchet assembly wherein said drum and ratchet assemblies include spacer means for mounting said cable a predetermined height above said mortar and said ratchet assembly includes means for tensioning said cable so as to form a guide wire; and a float assembly comprising float means for imparting a groove to said mortar when slid across the surface thereof and track means for slidably engaging said cable.

2. The combination in accordance with claim 1 wherein the spacer means is said drum assembly comprises a pair of flanges joined by a center section, one lfange being perforated to accomodate a stabilizer stake and adapted to rest on the surface of a form, the other being adapted to engage said cable and said center section being hollow to mountably accomodate said stabilizer stake.

3. The combination in accordance with claim 1 wherein the spacer means in the ratchet assembly comprises a housing adapted to mount on a stabilizer stake and rest on a form a predetermined height above said mortar and said tensioning means comprises a ratchet for winding said cable.

4. The combination in accordance with claim 1 wherein said float means comprises a float having a rib on one side and a handle bracket on the other.

5. The combination in accordance with claim 4 wherein said track means comprises opposed track brackets mounted on said float on either side of said handle bracket.

6. The combination in accordance with claim 4 wherein said track brackets are slotted to accomodate said cable and said slots are coincident to each other to lie on a line parallel with said rib.

7. The combination in accordance with claim 6 wherein the slots in track brackets are open to readily accomodate said cable.

* * * * *